US010131407B1

(12) United States Patent
Ruddy et al.

(10) Patent No.: US 10,131,407 B1
(45) Date of Patent: Nov. 20, 2018

(54) MULTIHULL MULTIPLATFORM FLOATING VESSEL

(71) Applicants: Kenneth Edward Ruddy, Houston, TX (US); Robert Hoff, Houston, TX (US); Andrew Martin Ruddy, Houston, TX (US)

(72) Inventors: Kenneth Edward Ruddy, Houston, TX (US); Robert Hoff, Houston, TX (US); Andrew Martin Ruddy, Houston, TX (US)

( * ) Notice: Subject to any disclaimer, the term of this patent is extended or adjusted under 35 U.S.C. 154(b) by 0 days.

(21) Appl. No.: 16/026,443

(22) Filed: Jul. 3, 2018

Related U.S. Application Data

(60) Provisional application No. 62/650,466, filed on Mar. 30, 2018.

(51) Int. Cl.

| | |
|---|---|
| ***B63B 3/08*** | (2006.01) |
| ***B63B 35/44*** | (2006.01) |
| ***B63B 39/10*** | (2006.01) |
| ***B63B 43/04*** | (2006.01) |
| *B63B 21/20* | (2006.01) |

(52) U.S. Cl.
CPC ..... *B63B 3/08* (2013.01); *B63B 35/44* (2013.01); *B63B 39/10* (2013.01); *B63B 43/04* (2013.01); *B63B 2003/085* (2013.01); *B63B 2021/203* (2013.01); *B63B 2035/448* (2013.01); *B63B 2039/105* (2013.01)

(58) Field of Classification Search
CPC ..... B63B 35/00; B63B 35/44; B63B 35/4413; B63B 21/20
USPC ..... 114/61.1, 261, 264, 265, 266, 267
See application file for complete search history.

(56) References Cited

U.S. PATENT DOCUMENTS

| | | | | |
|---|---|---|---|---|
| 5,588,387 | A * | 12/1996 | Tellington | B63B 35/50 114/264 |
| 5,735,228 | A * | 4/1998 | Huang | B63B 35/34 114/266 |
| 6,196,151 | B1 * | 3/2001 | Grant | B63B 35/34 114/266 |
| 8,312,828 | B2 * | 11/2012 | Luo | B63B 9/065 114/61.1 |
| 2013/0139743 | A1 * | 6/2013 | Khachaturian | B63B 35/00 114/264 |

* cited by examiner

*Primary Examiner* — Lars A Olson
(74) *Attorney, Agent, or Firm* — Buskop Law Group, P.C.; Wendy Buskop

(57) ABSTRACT

A multihull multiplatform floating vessel with a plurality of longitudinal hulls, a plurality of pin connectors; each pin connector providing one axis motion, a plurality of joints, each joint providing two axis motion, wherein the first joint is mounted on one hull the second joint is mounted on a second hull and wherein one group of pin connectors is mounted on one hull and a second group of pin connectors is mounted on the second hull. A first moveable planar platform is connected to the hulls and a second moveable planar platform is connected to the hulls by the pin connectors and joints, the platforms spaced apart from each other forming a platform void between pairs of platforms, and a hull void between pairs of hulls increasing safety onboard and decreasing motion of the moveable planar platforms as mounted to the longitudinal hulls.

20 Claims, 11 Drawing Sheets

MULTIHULL MULTIPLATFORM FLOATING VESSEL

CROSS REFERENCE TO RELATED APPLICATIONS

The present application claims priority to and the benefit of U.S. Provisional Patent Application Ser. No. 62/650,466 filed on Mar. 30, 2018, entitled "MULTIHULL MULTI-PLATFORM FLOATING VESSEL" (our reference 3313.001). This reference is hereby incorporated in its entirety.

FIELD

The invention generally relates to a multihull multiplatform floating vessel.

BACKGROUND

A need exists for a floating vessel which can be expanded in size based on business needs easily and without the need to be permanently affixed together to accommodate different deck configurations, and user needs.

The present embodiments meet these needs.

BRIEF DESCRIPTION OF THE DRAWINGS

The detailed description will be better understood in conjunction with the accompanying drawings as follows.

Figure 1:
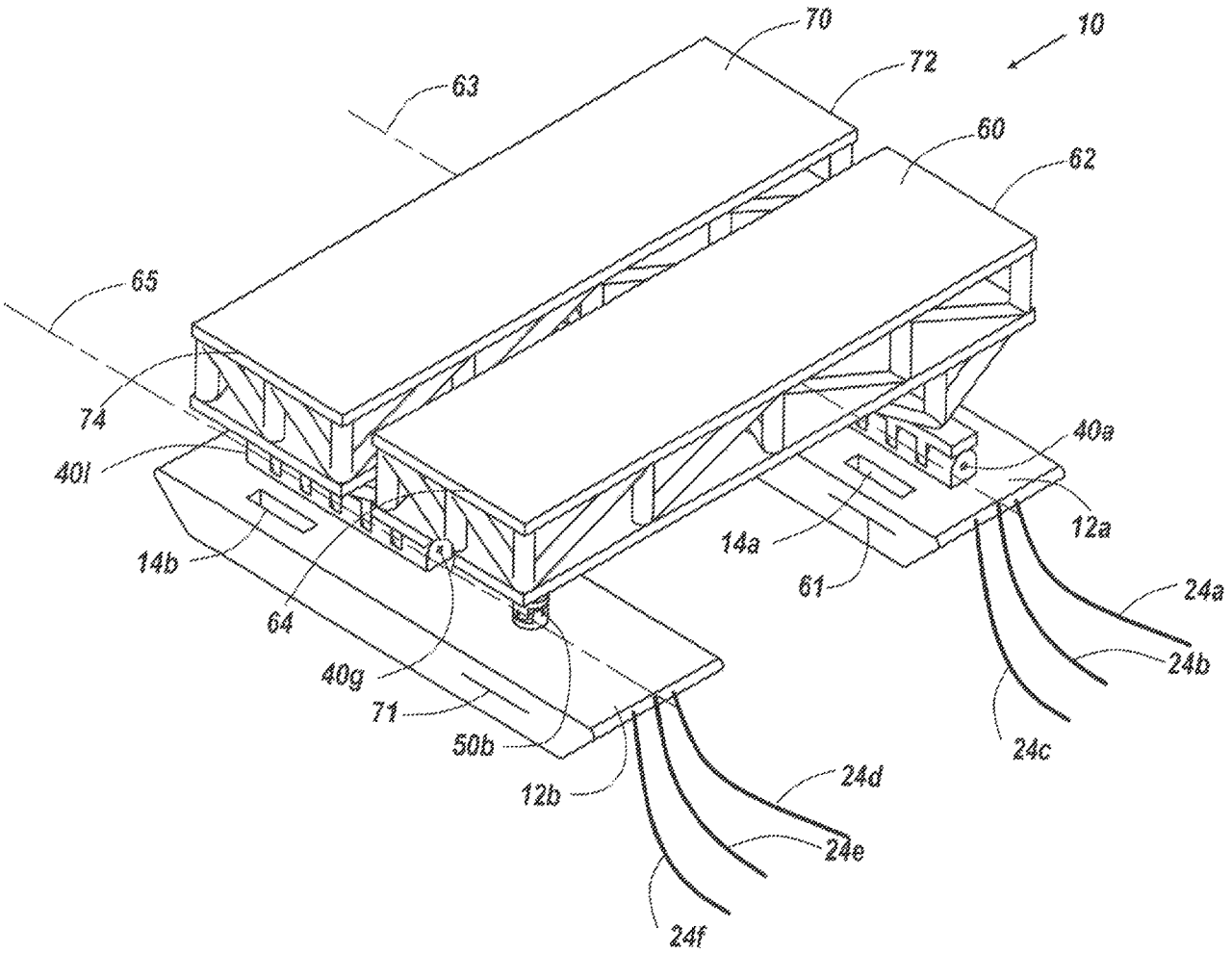
FIG. 1 depicts a top perspective view of an assembled flexible, expandable multihull multiplatform floating vessel according to one or more embodiments.

The present embodiments are detailed below with reference to the listed Figures.

DETAILED DESCRIPTION OF THE EMBODIMENTS

Before explaining the present multihull floating vessel in detail, it is to be understood that the multihull floating vessel is not limited to the particular embodiments and that it can be practiced or carried out in various ways.

The invention relates to a multihull multiplatform floating vessel.

The multihull multiplatform floating vessel has a plurality of longitudinal hulls and a mooring system.

Each hull has a plurality of pin connectors and a joint.

Each joint provides two axis motions. A first joint is mounted on a first hull diagonal to a second joint mounted on a second hull. More specifically, the first joint is not in parallel with the second joint.

Embodiments contemplate using 1 to 30 joints mounted to each longitudinal hull, and wherein each joint is a member of the group comprising: a universal joint, a ball joint, a spring, and a constant velocity joint.

Each pin connector provides one axis motion.

The pin connectors and joints allow for movement and provide a stable connection for moveable planar platforms connected to the hulls.

The multihull multiplatform floating vessel has a first moveable planar platform positioned over the plurality of hulls, generally at a right angle to the longitudinal axis of each hull.

The multihull multiplatform floating vessel has second moveable planar platform positioned over the hulls and specifically, spaced apart from the first moveable planar platform creating a platform void between pairs of moveable planar platforms.

The multihull multiplatform floating vessel also has a hull void extending between pairs of hulls.

The combination of platform voids, hull voids, and moveable re-connectable planar platforms provides not only increased safety onboard by spacing apart onboard activities into discrete platforms.

The combination also provides a decrease of 15% of an amplitude of motion of the moveable planar platform as mounted to the longitudinal hulls when moored wherein the motion is induced by environmental loading.

The multihull multiplatform floating vessel prevents environmental harm due to the enhanced stability of the vessel in the offshore marine environment. An incident is much less likely to occur due to the enhanced stability. For example, hydrocarbon processing equipment, such as a horizontal separator, is sensitive to vessel motions. Excessive motions cause the fluids to accelerate within the processing equipment. Excessive motion can lead to a process upset, which often leads to a discharge from the processing equipment. The probability of process upset occurring is much less with the current invention due to the enhanced stability.

Due to the enhanced stability and the decreased likelihood of a process upset and the ensuing discharge of hydrocarbons, the vessel design also decreases the likelihood of explosions and fire. This decreased risk of fire and explosions makes the vessel design much safer for personnel, reducing the potential for loss of life.

In addition, in current conventional technologies, the limited area available for equipment mandates that the equipment is closely spaced and stacked. The proximity of the equipment and the vertically layered equipment assists the spread of fire or chain reactions in the case of explosions. With current technologies, the crude oil, condensates, and liquefied natural gas is stored in close proximity with the process equipment and the power generation equipment. This proximity also increases the risk of fire and explosion. Fires and explosions would cause damage/loss to the floating vessel and personnel injury or loss of life.

The current invention moves hydrocarbon storage a distance away from process equipment and personnel. This distance allows more spacing of the process equipment. The distance between equipment both minimizes the risk of fire or explosion, and improves the safety of personnel if a fire or explosion does occur.

The following terms shall be used herein:

The term "alongside" refers to a mounting position on the side of the longitudinal hull rather than on the top of the longitudinal hull or on the deck of the longitudinal hull.

The term "dampened total motion" refers to dampening of all the different motions of each moveable planar platform relative to all the different motions of the longitudinal hulls.

The term "diagonal" as used herein refers to the lines connecting joints across two longitudinal hulls taking the form of a leg of a triangle, such as a leg to an isosceles triangle or a leg of right triangle.

The term "flexible and expandable" refers to the floating vessel which can start with only two parallel longitudinal hulls, but then can be expanded to three, four, or more parallel longitudinal hulls supporting the moveable planar platforms. Expandable refers to adding or subtracting hulls or platforms. Additionally, the longitudinal hulls can be of varied length or width, depending on the weights to be placed on that zone of the moveable planar platform. The phrase "flexible and expandable" not only refers to adding or subtracting longitudinal hulls under moveable planar platforms but adding or subtracting moveable planar platforms over longitudinal hulls. The moveable planar platforms can be of varying sizes, such as a first one might be 400 feet by 40 feet, but the second, parallel moveable planar platform can be 200 feet by 80 feet.

The term "floating vessel" can refer to a floating structure, that when assembled forms a floating barge-like vessel, a floating ship-like vessel, or a floating semi-submersible like vessel. The term "like" is used because this floating vessel requires at least two hulls and is not a monohull.

The term "a hull void" refers to an open space between pairs of longitudinal hulls, that prevents hull collision as longitudinal hulls move independently, such as a rectangular space, or another slot like space without equipment and without other extra structural members allowing for three axis movement (in each of x, y and z directions) of the two longitudinal hulls while maintaining the structural link. For example, between a pair of longitudinal hulls, the air gap (hull void) can be 100 feet wide and 800 feet long.

The term "joint" refers to an inter-engageable device that has two axis motion, and has a two part structure, one part on the longitudinal hull and one part on either the support structure or the moveable planar platform of the invention.

The term "longitudinal axis" as used for each longitudinal hull refers to the axis from bow to stern not from port to starboard of the each longitudinal hull.

The term "one axis motion" refers to rotation about a single fixed axis, or the motion within the definition "one degree of freedom."

The term "pin connector" refers to an inter-engageable device that has one axis motion, and has a two part structure, one part on the longitudinal hull and one part on either the support structure or the moveable planar platform of the invention. In embodiments, the invention uses a plurality of pin connectors with each pin connector providing one axis motion. A first pin connector can be is mounted above or alongside the first longitudinal hull and a second pin connector can be mounted above or alongside the second longitudinal hull.

The term "platform void" refers to an open space between pairs of moveable planar platforms, that prevents platform collision as longitudinal hulls move independently, such as a round space, a rectangular space, or another shaped space without equipment and without other structural members allowing for three axis movement (in each of x, y and z directions) of the two hulls while maintaining the structural link. For example, between a pair of moveable planar platforms, the air gap can be 22 feet wide and 400 feet long. In another example, the air gap forming the platform void can have a 100 foot diameter. The platform void can be a slot or another shape, like the circular shape of a moon pool. In embodiments, the platform void extending between pairs of moveable planar platforms is oriented at an angle from 30 degrees to 150 degrees to the hull void.

The term "preset distance above a load line" refers to a distance that is calculated based on Metocean conditions of the environment in which the floating vessel of the invention will operate. For example, in calm inland waters, the Metocean conditions could be from 1 foot to 3 foot swell and the preset distance from the load line would be small. As another example, the Antarctic waters near South Africa have swells from 50 to 70 feet, and accordingly the preset distance from the load line would be much larger than calm water, such as 120 feet above the load line, wherein the 1 to 3 foot swell preset distance could be 10 feet above the load line.

The term "removeably and detachably" refers to a connecting device portion (pin connector or the joint) that can be completely disengaged from the connecting device portion attached to the longitudinal hull.

The term "spaced apart" when referring to the distance apart between pairs of longitudinal hulls can refer to a distance from 1.6 feet to 1000 feet.

The term "structural link" refers to a connection that supports loads which are attempting to split apart the longitudinal hulls. The structural link can stay solid without breaking even if weight of from 3000 tons to 50,0000 tons is placed on the platforms. The term "structural link" additionally refers to a connection that maintains the substantially parallel configuration of the longitudinal hulls in spite of wind, waves and current. For example, it is contemplated that the "structural link" of the platforms on the hulls can resist differential torque applied by waves, current, and/or wind to the longitudinal hulls that can be from 100 million to 5 billion foot pounds in a secure, unbreakable connection.

The term "substantially parallel" refers to two longitudinal hulls which are either parallel to each other or wherein one of the longitudinal hulls is oriented at an angle from 0.1 degrees to 29 degrees from the other longitudinal hull.

The term "total motion" refers to the six motions of a floating body to include (1) forward/backward (surge), (2) up/down (heave), (3) left/right (sway) as translated into three perpendicular axes, as well as motion of a floating vessel around vertical, transverse and longitudinal axes. The remaining three movements around those three axes being (4) roll, (5) pitch and (6) yaw.

The term "two axis motion" refers to rotation about two fixed axes, or the motion within the definition "two degrees of freedom".

FIG. 1 depicts a top perspective view of an assembled flexible, expandable multihull multiplatform floating vessel 10.

The multihull multiplatform floating vessel has a plurality of longitudinal hulls 12*a* and 12*b*.

Each longitudinal hull is spaced apart from and substantially parallel to another longitudinal hull. Multiple longitudinal hulls can be used.

The multihull multiplatform floating vessel can have least one product storage tank 14*a* as shown in longitudinal hull 12*a*.

In embodiments, each longitudinal hull can have a product storage tank, a second product storage tank 14*b* is shown in longitudinal hull 12*b*.

In embodiments, at least one tank can be configured to allow adjustment of the draft of each longitudinal hull. Multiple tanks can be configured to allow adjustment of the draft of the multihull multiplatform floating vessel.

In embodiments, the product storage tank can be a pressurized product storage tank 14*b* (shown in FIG. 5) storing a flowable particulate, a liquid, a vapor/liquid combination, or compressed natural gas. The pressurized product storage tank is configured to withstand pressure between 0.4 psi and 5000 psi without deforming. The product storage tank has a fixed lid 19 and baffling 22*abcd* and 22*e* internal to the tank.

Returning to FIG. 1, some of the longitudinal hulls have a mooring system.

In embodiments, all of the longitudinal hulls have a mooring system.

FIG. 1 shows each hull having a mooring system. Six of twelve mooring lines 24*a*-24*f* are depicted. The mooring system can be a spread mooring system or a mooring system tied to a buoy, which in some cases is known as a turret system.

In other embodiments, the mooring system can be a station keeping system such as a dynamic positioning system with thrusters or propellers attached to or built into one or more of the longitudinal hulls.

A plurality of pin connectors can be used to engage a moveable planar platform to one of the longitudinal hulls. Each pin connector provides one axis motion.

FIG. 1 shows a first pin connector 40*a* mounted to the first longitudinal hull 12*a*. Additional pin connectors can be mounted to the first longitudinal hull 12*a*.

FIG. 1 shows a plurality of pin connectors 40*g* and 40*l* mounted to a second longitudinal hull 12*b*.

Each pin connector has a hull portion and a platform portion. The hull portion engages the platform portion through a pin.

Each longitudinal hull can have one or more pin connectors and at least one joint in a spaced apart relationship usually mounted to a deck of the longitudinal hull in alignment with the longitudinal axis.

Figure 2:
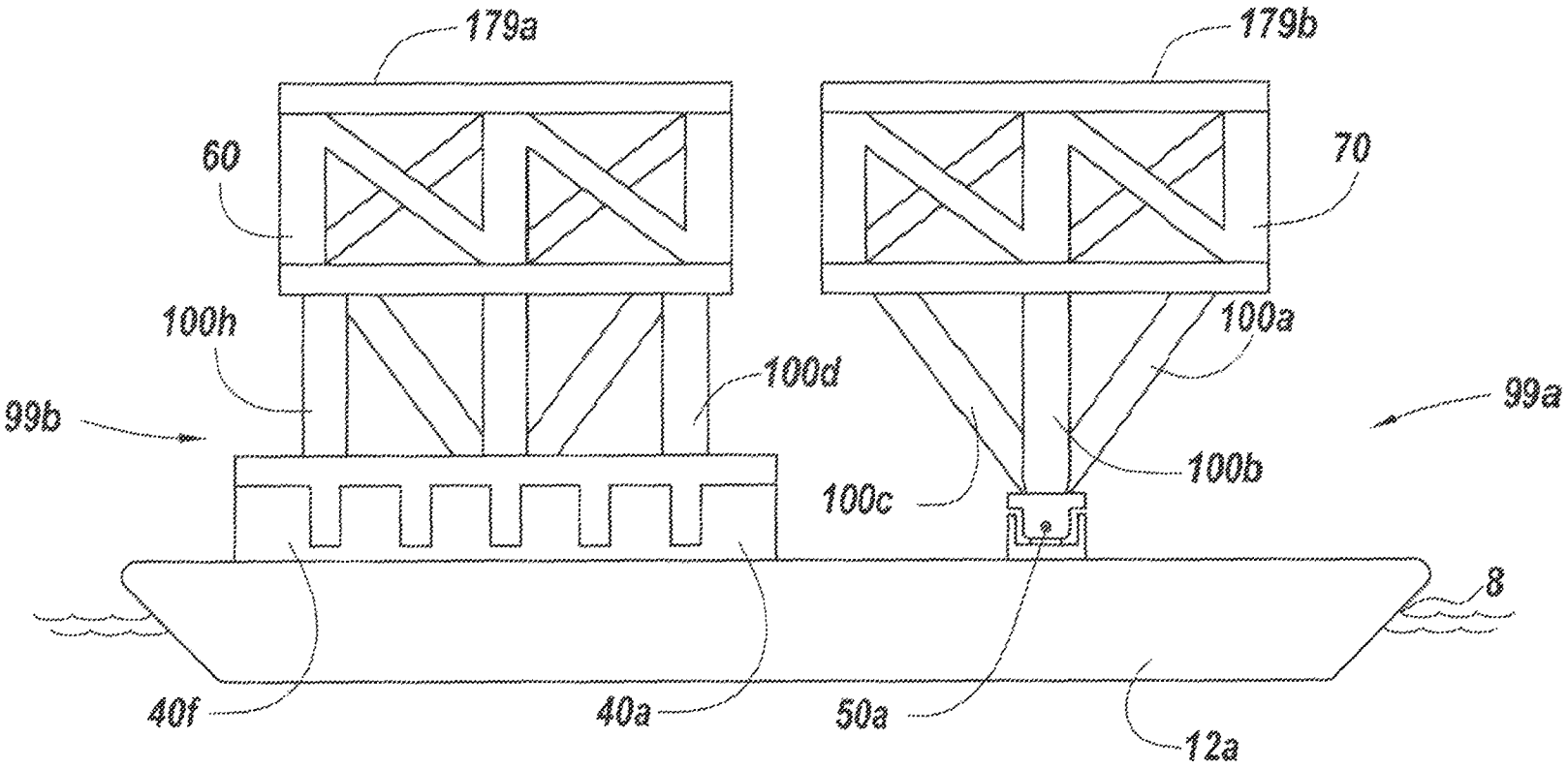
FIG. 2 is a side view of the floating vessel including the connections engaging moveable planar platforms according to one or more embodiments.

Joint 50*b* is shown in FIG. 1 on longitudinal hull 12*b* and joint 50*a* is shown in FIG. 2 on longitudinal hull 12*a*. The joints can each be a universal joint.

Even though a single joint is depicted on each longitudinal hull in FIG. 1, in other embodiments a plurality of joints can be used to connect moveable planar platforms to the longitudinal hulls with the pin connectors.

It is the combination of pin connectors and joints that enables the damping of the motion which is a feature of the invention.

The combination of pin connectors and joints on each hull uncouple much of the movement of the longitudinal hulls from the moveable planar platforms which provides a dampening of platform movement for increased safety at sea.

Each joint provides two axes motion, namely "y axis" motion in the direction of the longitudinal axis of the longitudinal hull and "x axis" motion in a direction 90 degrees from the direction of the longitudinal axis of the longitudinal hull.

The joint 50*a* is mounted to the first longitudinal hull 12*a* in a manner to align with the pin connectors mounted to the second longitudinal hull 12*b*.

FIG. 1 shows a joint 50*b* mounted to the second longitudinal hull 12*b* aligned with the pin connector 40*a* of the first longitudinal hull.

In embodiments, the pin connectors and joints can be longitudinally aligned on the same longitudinal hull.

In embodiments, the joint on one longitudinal hull can be mounted diagonal to the joint on an adjacent longitudinal hull.

Returning again to FIG. 1, a first moveable planar platform 60 is shown mounted across the two longitudinal hulls 12*a* and 12*b*.

The first moveable planar platform 60 is shown having a first end 62 removeably secured to the first longitudinal hull 12*a*. The first moveable planar platform 60 is shown having a second end 64 removeably secured to the second longitudinal hull 12*b*.

The first moveable planar platform 60 is oriented perpendicular, in this Figure, to a longitudinal axis of each longitudinal hull. The first longitudinal hull 12*a* has longitudinal axis 63. The second longitudinal hull has longitudinal axis 65.

The first moveable planar platform 60 is mounted above the longitudinal hulls 12*a* and 12*b*. The first moveable planar platform is shown having a surface.

A second moveable planar platform 70 is shown mounted across the two longitudinal hulls 12*a* and 12*b*.

The second moveable planar platform 70 is shown having a first end 72 removeably secured to the first longitudinal hull 12*a*. The second moveable planar platform 70 is shown having a second end 74 removeably secured to the second longitudinal hull 12*b*.

The second moveable planar platform is oriented perpendicular to a longitudinal axis of each longitudinal hull 63 and 65.

The first end 62 of the first moveable planar platform 60 is removeably and detachably engaging a plurality of pin connectors mounted to the first longitudinal hull, pin connector 40*a* is shown in FIG. 1 with the plurality of pin connectors 40*a*-40*f* shown in FIG. 2.

The second end 64 of the same moveable planar platform 60 is shown in FIG. 1 as removeably and detachably engaging the joint 50*b* on the second longitudinal hull 12*b*.

The first end 72 of the second moveable planar platform 70 removeably and detachably engages a joint not shown on longitudinal hull 12*a*.

The second end 74 of the same second moveable planar platform 70 (shown in FIG. 1) engages a plurality of pin connectors 40*g*-*l* on the second hull 12*b* (shown in FIG. 2) simultaneously while the first end 72 removeably and detachably engages the joint 50*a* (shown in FIG. 2) of the first longitudinal hull 12*a*.

The second moveable planar platform 70 is also mounted above the longitudinal hulls. In FIG. 1, the second moveable planar platform is shown having a surface.

Each moveable planar platform extends across the plurality of longitudinal hulls and forming a structural link there between, above the normal operating waterline 8 (shown in FIG. 2) of the multihull floating vessel.

FIG. 1 shows an embodiment, wherein the first moveable planar platform 60 is mounted a preset distance above a load line 61 of the first longitudinal hull.

FIG. 1 also shows the second moveable planar platform 70 mounted a preset distance above a load line 71 of the second longitudinal hull.

The floating vessel is formed with a plurality of platform voids and hull voids which are provided in more detail in later figures.

The formed multihull multiplatform floating has a configuration that is flexible and expandable without permanently affixing the moveable planar platforms to the longitudinal hulls, while simultaneously the multihull multiplatform floating vessel (i) provides separate work spaces for increased safety onboard, (ii) provides independent pitch and roll motion for each longitudinal hull, and (iii) provides dampened total motion of the moveable planar platforms by an average of at least 10% as compared to total motions of each longitudinal hull depending on environmental loading.

In embodiments, the multihull multiplatform floating provides dampened total motion of the moveable planar platforms by up to 50% as compared to total motions of each longitudinal hull depending on environmental loading. It is contemplated that the dampened total motion can be any number between 10% and 50%.

Typically, as the size of conventional ocean-going vessels increases, the amount of material (e.g. steel) used to resist the environmental loads, increases non-linearly. In other words, if the size or capacity of a particular vessel design is increased 10%, more than 10% additional material is needed to ensure it can withstand the environmental loads. This non-linear relationship limits the practical, cost-effective size and capacity of such floating vessels.

With the current invention, the connections between the planar platform structures and the buoyancy members have certain degrees of freedom. In this manner, the motions of the buoyancy members responding to environmental loads are de-coupled from the platform structure(s). This de-coupling minimizes or dampens the loads imparted on the structure. The amplitude of the floating vessel motions (the response) is about half that of a conventional mono-hull floating vessel, for the same beam environmental loading.

The reduced loading reduces the amount and weight of material needed to support the platform structure(s). The de-coupling of floating vessel motions from the buoyancy members to the platform(s) allows the deck area and weight capacity to be easily increased, without an excessive increase in structural material to support the additional loads. Floating vessel lengths of 2,000 feet can be achieved cost-effectively with the invention.

The corresponding draft of the floating vessel of the invention can be comparable to very large crude container vessels, on the order of 40 to 80 feet, depending on loading.

A typical arrangement of moveable planar platforms may consist of two decks, namely an upper deck and a lower deck, stacked one on top of the other. Due to the enhanced stability of the vessel, the top-sides can be very tall compared to the existing state-of-the-art. For example, the topsides decks could consist of four decks 20 feet tall, stacked for a total of 80 feet, not including the freeboard of the buoyancy members and the height of the pin and joint connections. An alternative embodiment could consist of five decks 15 feet tall, stacked for a total of 75 feet, or eight decks 10 feet tall, stacked for a total of 80 ft.

FIG. 2 is a side view of the floating vessel showing the first longitudinal hull 12*a* floating in water having a waterline 8.

A plurality of pin connectors 40*a*-40*f* are shown is secured to the first longitudinal hull 12*a*.

A joint 50*a* is shown connected to the first longitudinal hull 12*a* in a spaced apart relationship to the plurality of pin connectors 40*a*-40*f* The joint and the plurality of pin connectors are aligned with the longitudinal axis of the longitudinal hull 12*a*.

Attached to the joint is a first support structure 99*a* having a plurality of support members 100*a*-100*c* for supporting the second moveable planar platform 70 which is shown having a surface 179*b*.

Attached to the plurality of pin connectors 40*a*-40*f* is a second support structure 99*b* having a plurality of support members 100*d*-100*h* for the first moveable planar platform 60. A surface 179*a* is shown forming the first movable planar platform.

Each moveable platform is positioned to have at least one width that is either: a width that extends between the longitudinal hulls without extending beyond the plurality of longitudinal hulls; a width that extends beyond each longitudinal hull; extends over portions of the longitudinal hulls, or a combination thereof.

The multihull multiplatform floating vessel can have 2 to 20 moveable planar platforms mounted over from 2 to 10 parallel longitudinal hulls.

Figure 3:
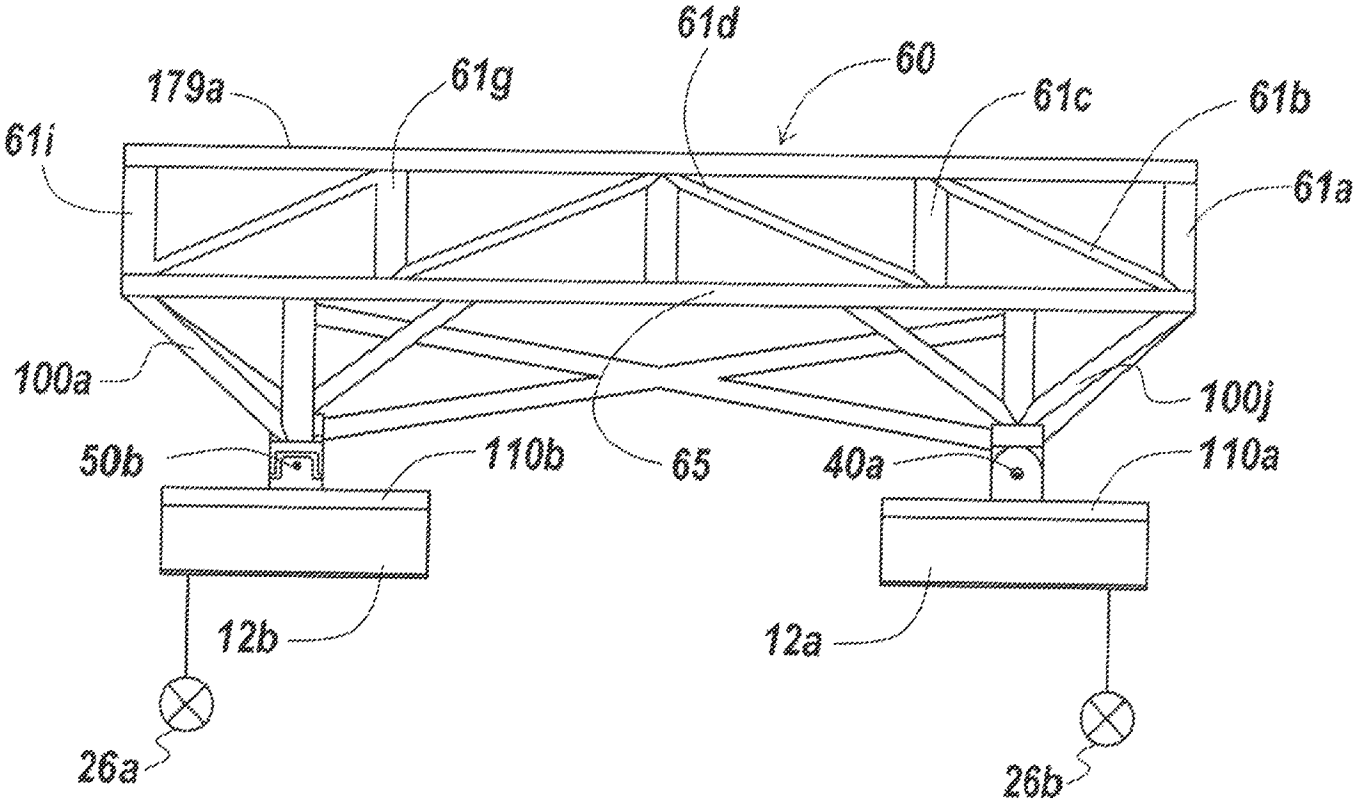
FIG. 3 depicts a single moveable planar platform across two hulls according to one or more embodiments.

FIG. 3 shows two longitudinal hulls 12*a* and 12*b*.

Each longitudinal hull in this FIG. 3 is shown with a deck, 110*a* and 110*b*, respectively.

Each longitudinal hull in this FIG. 3 has at least one thruster, thruster 26*a* and 26*b* are shown.

In this FIG. 3, the first moveable planar platform 60 with surface 179*a* is shown mounted to a first deck 110*a* of the first longitudinal hull 12*a* and a second deck 110*b* of the second longitudinal hull 12*b*.

In the embodiment of FIG. 3, the moveable planar platform 60 is connected to a plurality of structural members 61*a*-*i*, each structural member is shown connected to a base 65 supported by a plurality of support members 100*a*-100*j* for supporting the first moveable planar platform 60 to both the pin connectors (pin connector 40*a* is shown) and the joints (joint 50*b* is shown), with the labelled pin connector and joint on different longitudinal hulls.

Figure 4A:
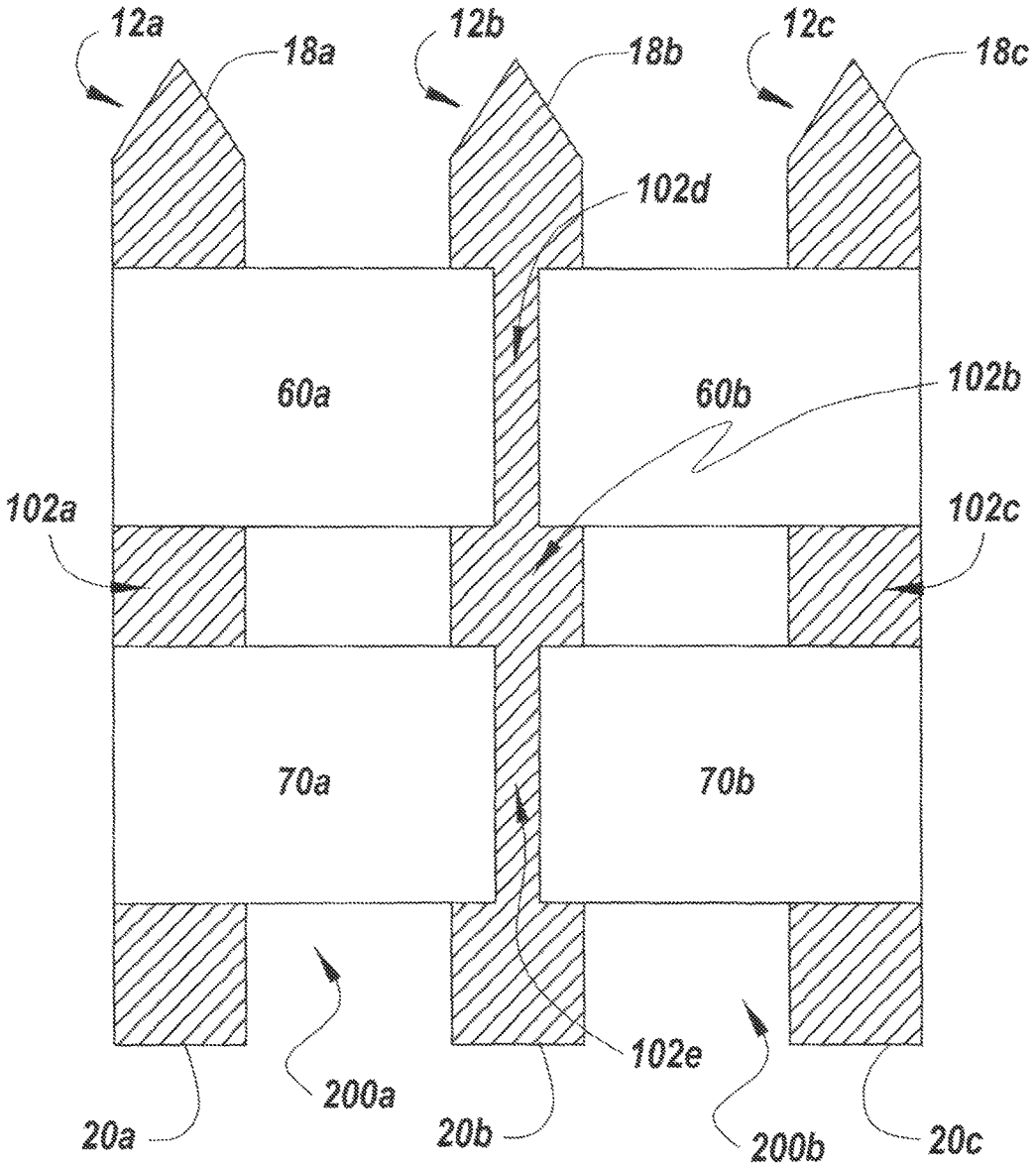
FIGS. 4A, 4B, and 4C depict different arrangements of the moveable planar platforms on multiple longitudinal hulls.
Figure 4B:
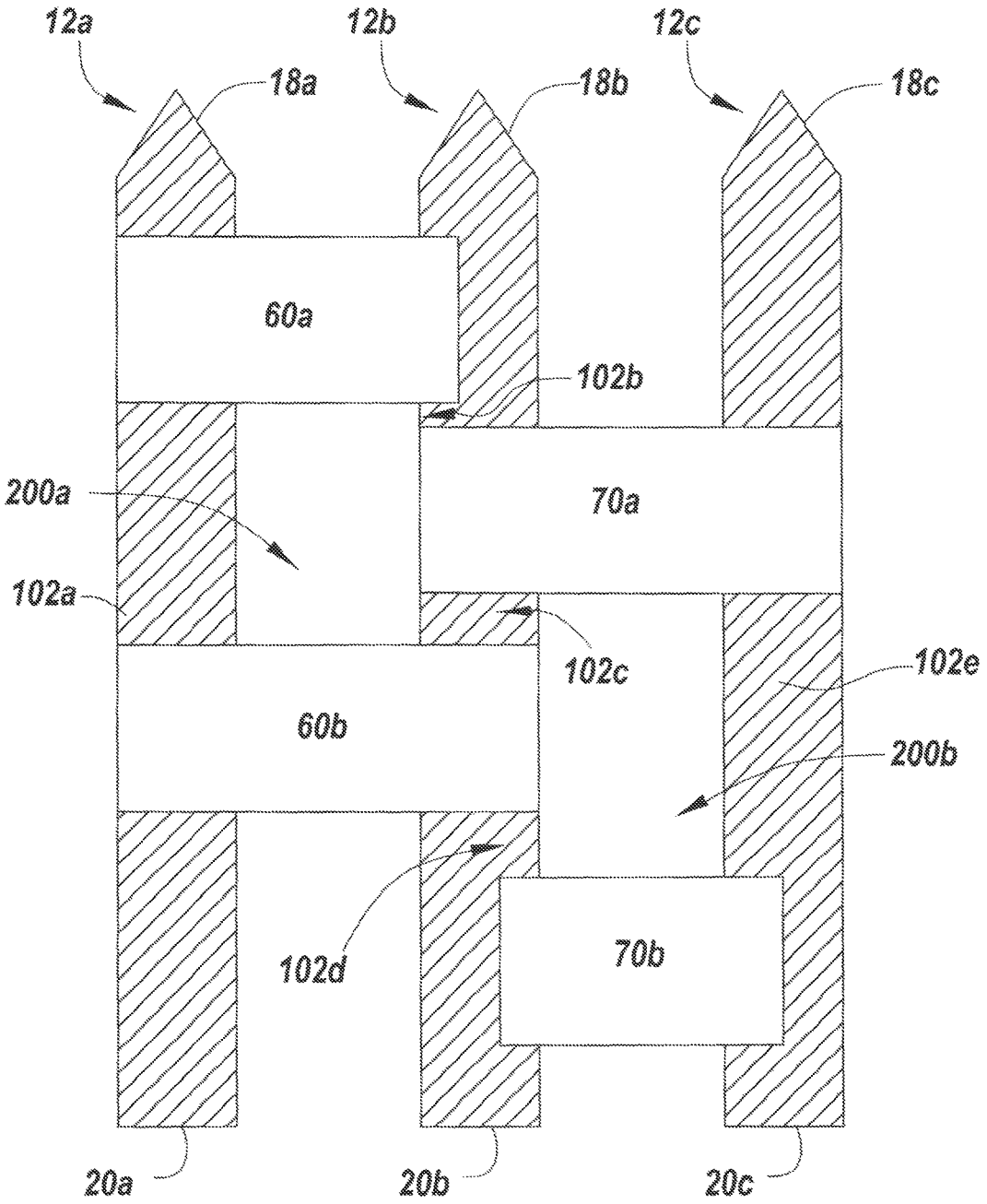
Figure 4C:
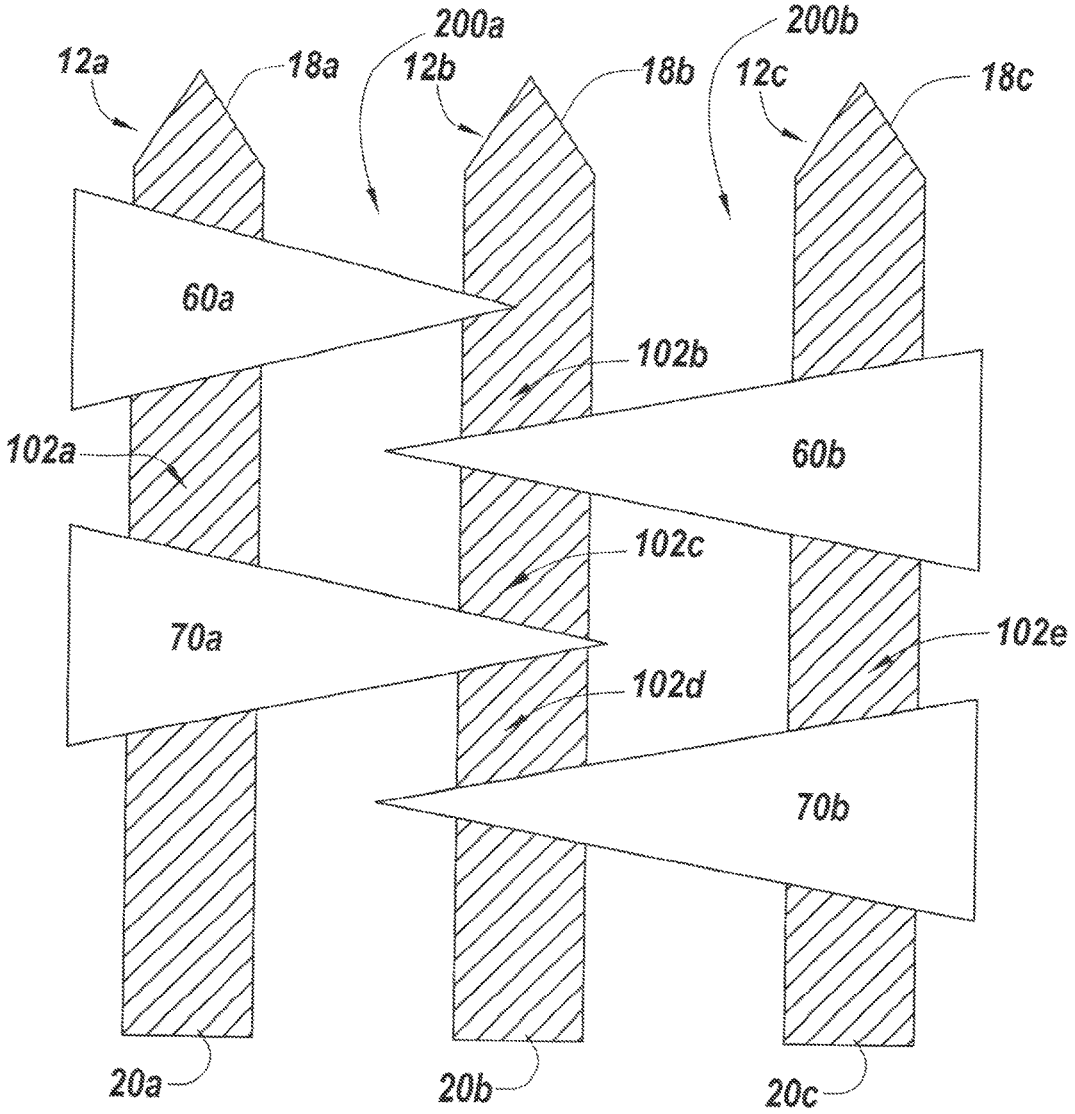

FIGS. 4A, 4B, 4C depict different arrangements of the moveable planar platforms on multiple longitudinal hulls.

FIG. 4A depicts three longitudinal hulls 12*a*-12*c*.

Each longitudinal hull is depicted with a bow and a stern.

Longitudinal hull 12*a* has bow 18*a* and stern 20*a*. Longitudinal hull 12*b* has bow 18*b* and 20*b*. Longitudinal hull 12*c* has bow 18*c* and a stern 20*c*.

FIGS. 4B and 4C shows the same components.

The bow shape or the stern shape, or both shapes can be a shape selected from the group: tapered to a flat face, rounded, or tapered to a point.

FIGS. 4A, 4B and 4C shows four different moveable planar platforms labelled 60*a*, 60*b*, 70*a*, and 70*b*.

In FIG. 4A multiple platform voids 102*a*-102*e* are shown extending between pairs of moveable planar platforms to provide increased safety for equipment and personnel on the platforms by preventing impact of longitudinal hulls together.

Also shown are multiple hull voids. FIG. 4A depicts hull voids 200*a* and 200*b* extending between pairs of longitudinal hulls.

In embodiments, each hull void can be configured to perform like a moon pool.

The formed multihull multiplatform floating vessel 10 is flexible and expandable in width while providing spaced apart work space on discrete spaced apart moveable planar platforms for increased safety onboard and a structural decrease of motion of the floating vessel.

FIG. 4B depicts four rectangular moveable planar platforms 60*a*, 60*b*, 70*a* and 70*b* are shown in a staggered arrangement over three longitudinal hulls 12*a*, 12*b* and 12*c*.

In FIG. 4B multiple platform voids 102*a*-102*e* are shown extending between pairs of moveable planar platforms to provide increased safety for equipment and personnel on the platform by preventing impact of longitudinal hulls together.

Also shown are a plurality of hull voids. For FIG. 4B hull voids 200*a* and 200*a* are depicted extending between pairs of longitudinal hulls.

FIG. 4C depicts four triangular shaped moveable planar platforms 60*a*, 60*b*, 70*a* and 70*b* in a staggered arrangement over three longitudinal hulls 12*a*, 12*b* and 12*c*.

In FIG. 4C multiple platform voids 102*a*-102*e* are shown extending between pairs of moveable planar platforms to provide increased safety for equipment and personnel on the platform by preventing impact of longitudinal hulls together.

Also shown is a plurality of hull voids. For FIG. 4C hull voids 200*a* and 200*b* are depicted extending between pairs of longitudinal hulls.

Figure 5:
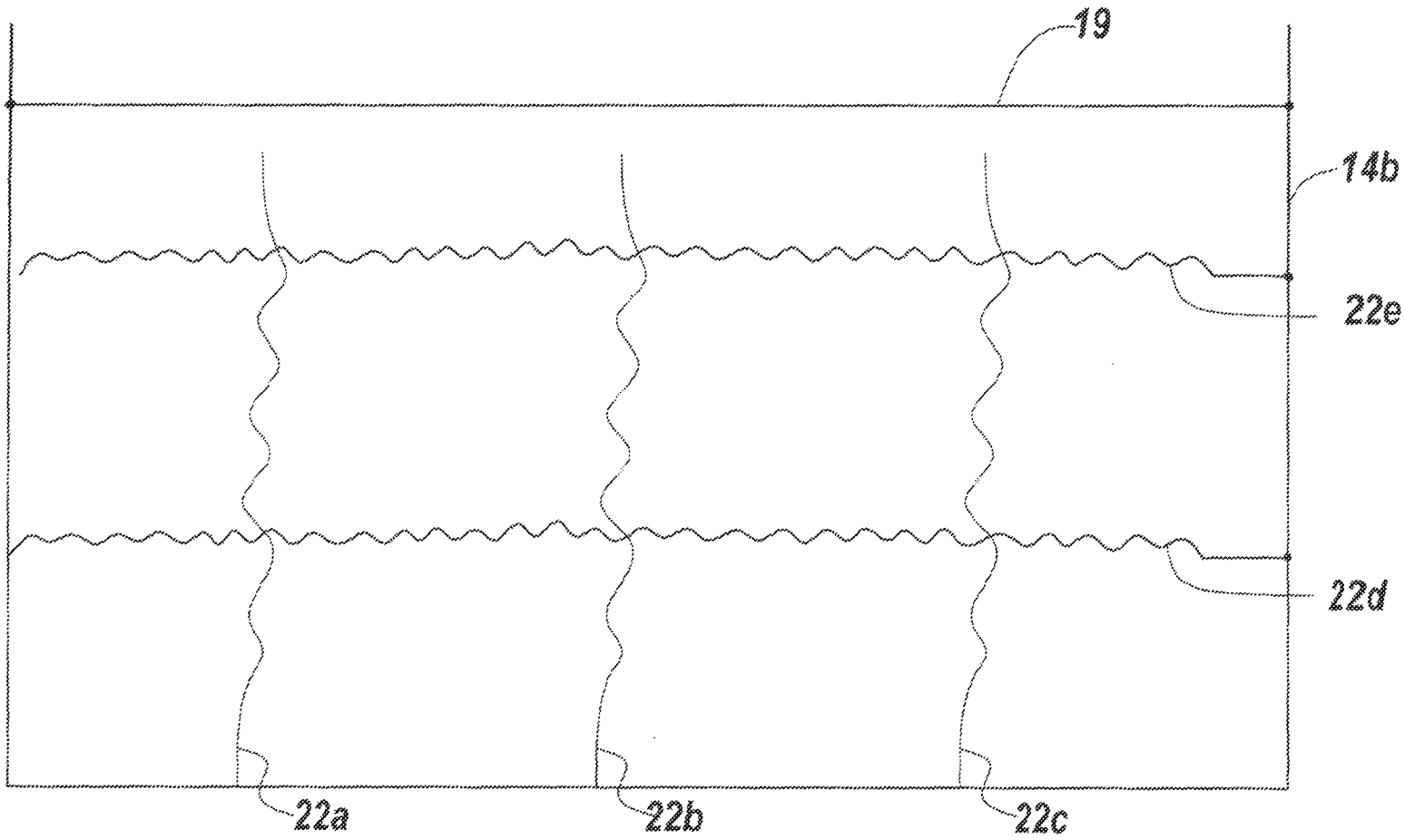
FIG. 5 depicts an exemplary product storage tank of the multihull multiplatform floating vessel according to one or more embodiments.

FIG. 5 depicts an exemplary product storage tank 14*b* of a multihull multiplatform floating vessel.

The product storage tank 14*b* is shown having a fixed lid 19 with vertical baffles 22*a*-22*c* and horizontal baffles 22*d*-22*e* all of which are internal to the product storage tank.

The baffles can be perforated in embodiments.

In embodiments, baffles can be mounted horizontally and in line with the longitudinal axis as well as perpendicular to the longitudinal axis of the longitudinal hull as shown in this FIG. 5.

Figure 6A:
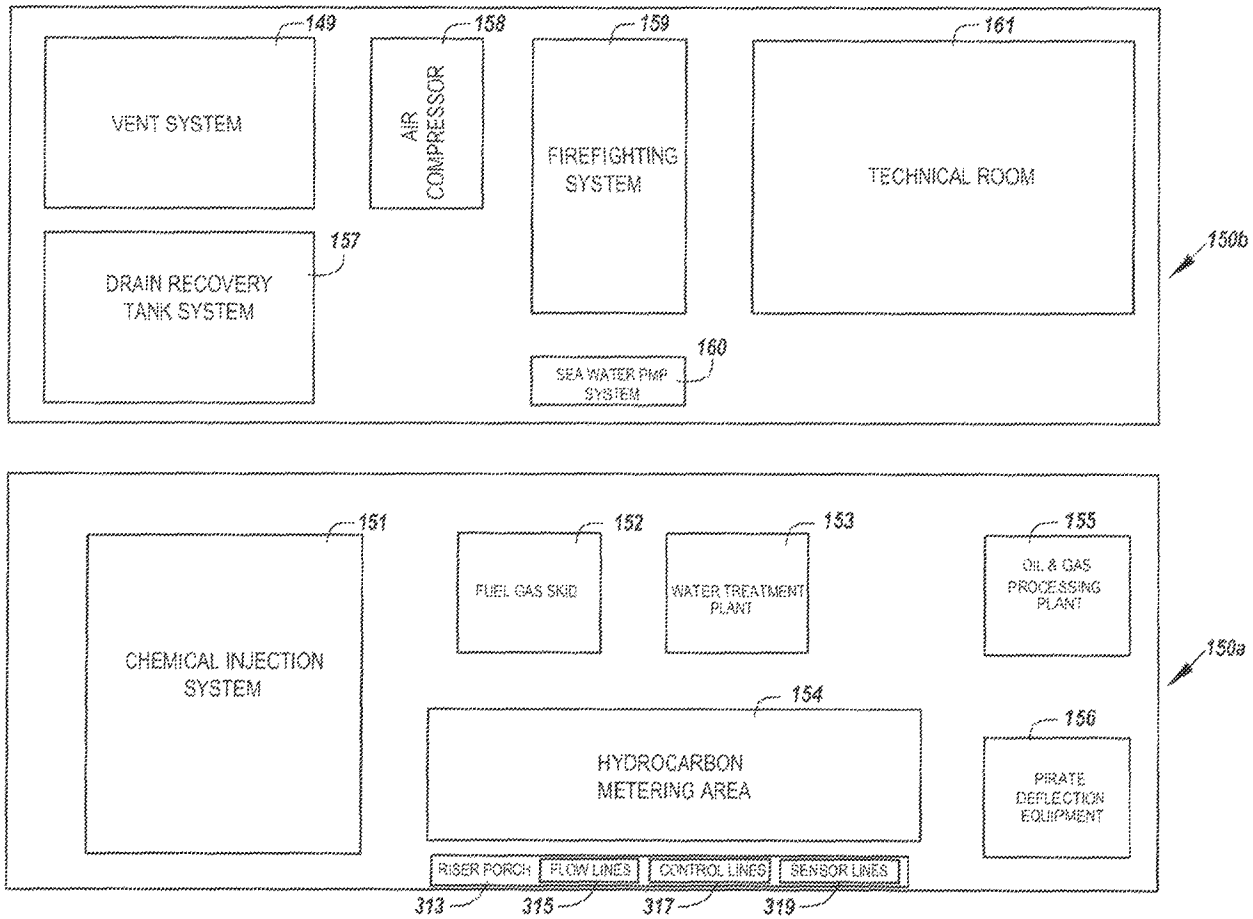
FIGS. 6A and 6B depict lower and upper deck arrangements for a vertically integrated multihull multiplatform floating vessel according to one or more embodiments.
Figure 6B:
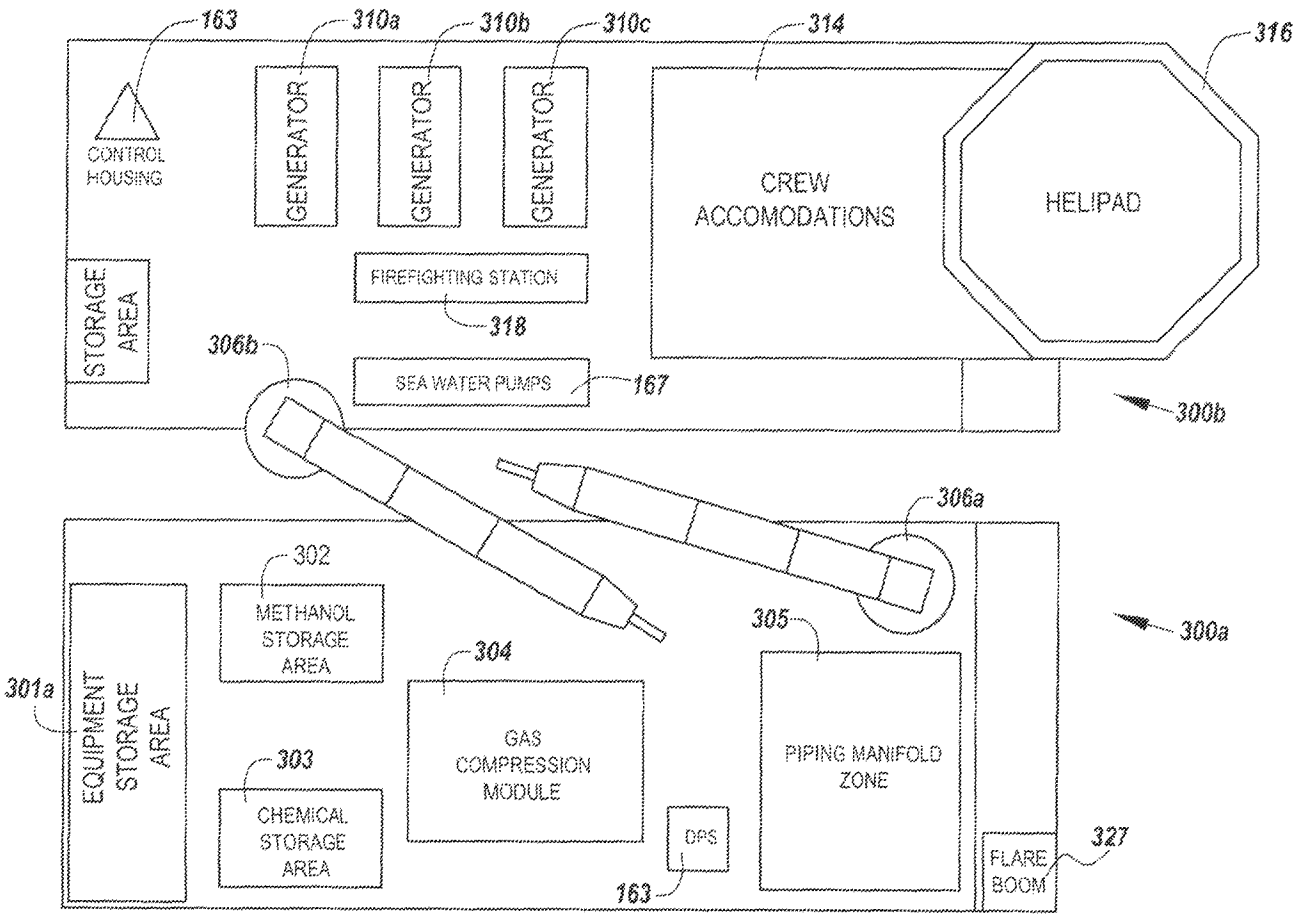

FIGS. 6A and 6B depict lower and upper deck arrangements, respectively for a vertically integrated multihull multiplatform floating vessel.

FIG. 6A shows two lower decks 150*a* and 150*b*, wherein each is a lower deck of a different moveable planar platform.

The lower deck 150*a* can have a chemical injection system 151, a fuel gas skid 152, a water treatment plant 153, a hydrocarbon metering area 154, and an oil and gas processing plant 155. Pirate deflection equipment 156 can be installed on the lower deck 150*a*.

Riser porch 313 can be mounted to the lower deck along with flow lines 315, control lines 317, and sensor lines 319.

The lower deck 150*b* can have a vent system 149, a drain recovery tank system 157, an air compressor 158, a firefighting system 159, a sea water pump system 160, and a technical room for crew 161.

FIG. 6B shows two different upper deck configurations as 300*a* and 300*b* for the integrated multihull multiplatform floating vessel. Upper deck 300*a* could be installed over lower deck 150*a* and upper deck 300*b* could be installed over lower deck 150*b*.

The upper decks are mounted over at least one of the moveable planar platforms wherein one of the upper decks contains a control housing 163 for a dynamic positioning system connected to thrusters mounted through at least one of the longitudinal hulls. The dynamic positioning system is electronically connected to the control housing.

The upper deck 300*a* can have an equipment storage area 301*a*, a methanol storage area 302, chemical storage area 303, gas compression module 304, a piping manifold zone 305, the dynamic positioning system (DPS) control housing 163, a first crane 306*a*, and a flare boom 327.

The other upper deck labelled as element 300*b* has a plurality of generators 310*a*, 310*b*, and 310*c* for producing power for all of the moveable planar platforms.

A second crane 306*b* is mounted to the upper deck 300*b*. Crew accommodations 314 can be on the upper deck 300*b* as well as a helipad 316. Additionally, a firefighting station 318 is installed on the upper deck and connected to the firefighting system.

Seawater pumps 167 can be installed on the upper deck 300*b* and used for ballasting the longitudinal hulls or for process cooling.

The multihull multiplatform floating vessel can have from 2 to 20 vertically integrated upper decks mounted over at least one moveable planar platform.

Figure 7:
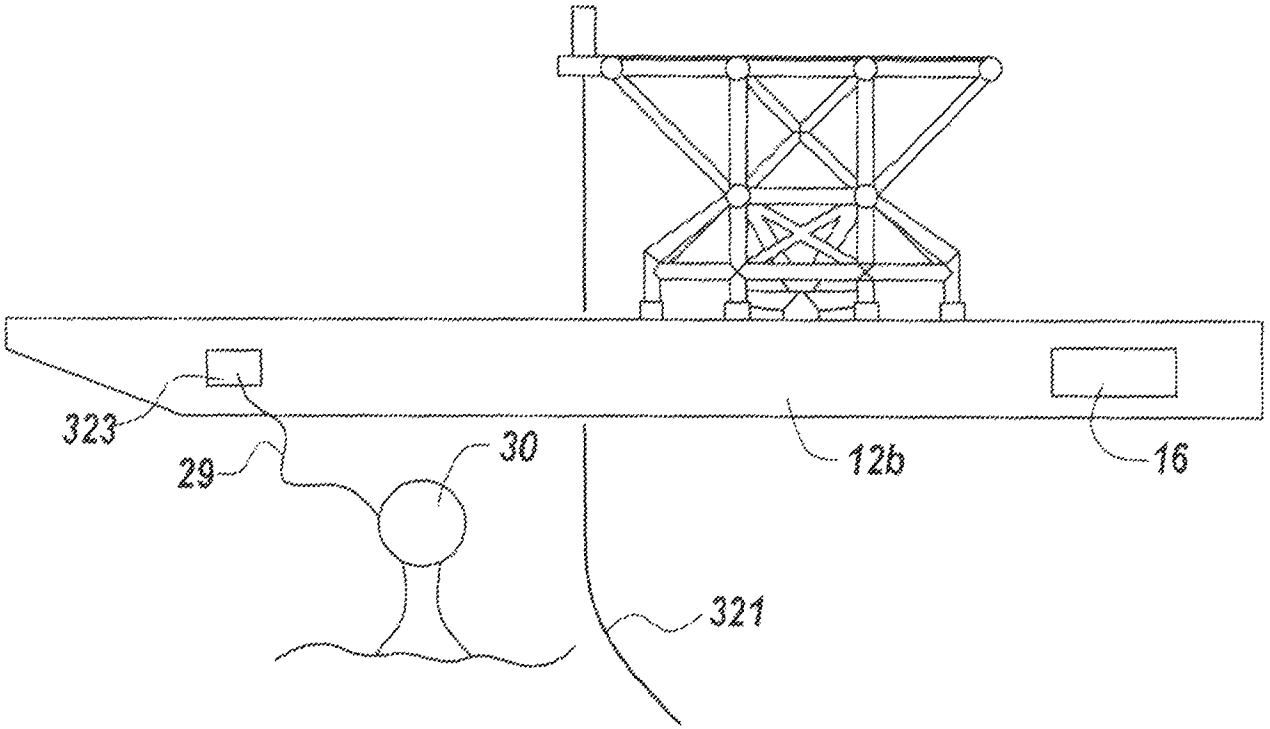
FIG. 7 depicts an offloading buoy connected to one of the hulls.

FIG. 7 shows one of the longitudinal hulls 12*b* is secured to an offloading buoy 30. The longitudinal hull can fluidly engage the offloading buoy 30 through one or more hoses 29. The hose 29 connects to equipment mounted on at least one of the moveable planar platforms to fluidly engage the offloading buoy 30.

FIG. 7 also shows ballast tank 16 and a riser 321 and a hose spooler 323 mounted in and within the longitudinal hull 12*b*.

Figure 8:
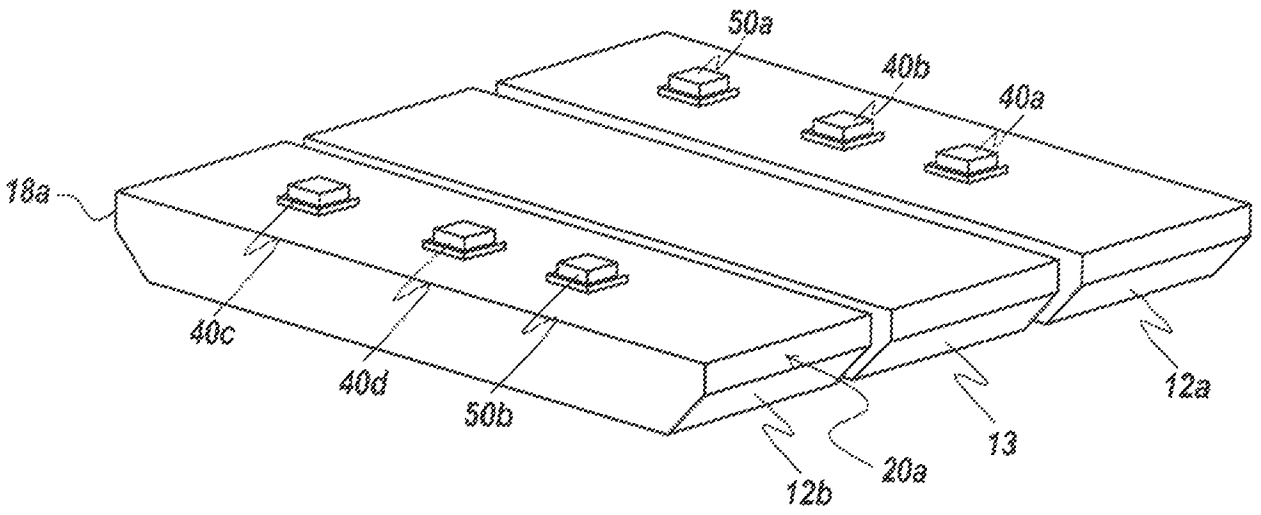
FIG. 8 depicts connectors and joints prior to engaging one or more moveable planar platforms of the multihull multiplatform floating vessel according to one or more embodiments.

FIG. 8 shows a top view of two longitudinal hulls 12*a*, 12*b* with a loading platform 13 between the longitudinal hulls. The loading platform is used temporarily for installing the planar moveable platforms to the longitudinal hulls.

Longitudinal hull 12*a* has bow 18*a* and stern 20*a*.

Longitudinal hull 12*a* is depicted with the plurality of pin connectors 40*a* and 40*b* on the first longitudinal hull 12*a*.

Longitudinal hull 12*b* is depicted with the plurality of pin connectors 40*d* and 40*c* on the second longitudinal hull 12*b*.

A first joint 50*a* is depicted mounted to the first longitudinal hull 12*a* aligned with the pin connectors 40*a* and 40*b*.

A second joint 50*b* is shown mounted to the second longitudinal hull 12*b* aligned with the pin connectors 40*c* and 40*d*.

The first joint 50*a* is mounted diagonal to the second joint 50*b*.

In embodiments, a ballast tank can be mounted in each longitudinal hull for adjusting trim and draft of the longitudinal hulls independently.

In embodiments of the multihull multiplatform floating vessel, the product storage tank stores a flowable particulate, a liquid, a vapor/liquid combination, or liquefied or compressed natural gas.

In embodiments, from 1 to 30 joints can be mounted to each longitudinal hull.

The joints 50*a* and 50*b* can be a member of the group comprising: a universal joint, a ball joint, and a constant velocity joint.

In embodiments of the multihull multiplatform floating vessel, each moveable planar platform can extend beyond the longitudinal hulls. If the moveable planar platform extends beyond the hull, that platform can be supported in cantilever-type fashion using support members.

Other embodiments of the multihull multiplatform floating vessel contemplate the vessel having from 2 to 20 moveable planar platforms mounted over from 2 to 10 parallel longitudinal hulls.

The multihull multiplatform floating vessel may have the 2 to 20 moveable planar platforms mounted in a staggered configuration over the plurality of parallel longitudinal hulls.

Versions of the multihull multiplatform floating vessel contemplate having 2 to 20 vertically integrated upper decks mounted over at least one moveable planar platform.

Embodiments contemplate that the multihull multiplatform floating vessel may include product storage tanks configured to withstand pressure between 0.4 psi and 5000 psi without deforming.

One version of the multihull multiplatform floating vessel can include a support structure having a plurality of support members secured to the first moveable planar platform and a plurality of support members secured to the second moveable planar platform, the support structure engaging the plurality of pin connectors and plurality of joints secured to the plurality of longitudinal hulls.

Example 1

One embodiment of the multihull multiplatform floating vessel can be an assembled vessel 600 feet length over all (LOA), a beam of 400 feet, and a loaded draft of 40 feet.

Two longitudinal hulls are used, each is 600 feet long.

Each longitudinal hull is spaced apart 180 feet and are parallel to each other.

Each longitudinal hull has a tapered bow and a rounded stern.

Each longitudinal hull has 5 pin connectors. Each pin connector provide one axis motion. In this example, each pin connector is mounted above the longitudinal hull.

In this example, each longitudinal hull has one joint. Each joint provides two axis motion. The first joint is mounted to the first longitudinal hull spaced apart from the first pin connector, and a second joint is mounted to the second longitudinal hull spaced apart from the second pin connector. The first and second joints are mounted diagonal to each other.

A first moveable planar platform that is 400 feet long by 180 feet.

A second moveable planar platform is the same size as the first.

A 40 foot platform void is created between the first and second moveable planar platforms.

Each moveable planar platform is mounted 45 feet above a load line of each longitudinal hull.

The first end of the first moveable planar platform removeably and detachably engages all five pin connector on the first longitudinal hull. The second end of the same moveable planar platform removeably and detachably engaging the single joint on the longitudinal hull opposite the pin connectors.

The second moveable planar platform has a first end that removeably and detachably engages all five pin connector on the second longitudinal hull. The second end of the same moveable planar platform removeably and detachably engaging the single joint on the first longitudinal hull opposite the pin connectors.

Each moveable planar platform extends across the plurality of longitudinal hulls and forming a two level structural link there between.

The 40 foot wide platform void extends between pairs of moveable planar platforms to provide increased safety for equipment and personnel on the moveable planar platform by preventing impact together of longitudinal hulls.

A hull void of 180 feet extends between pairs of longitudinal hulls.

The formed multihull multiplatform floating vessel 10 has a configuration that is flexible and expandable without permanently affixing the moveable planar platforms to the longitudinal hulls, while simultaneously the multihull multiplatform floating vessel (i) provides separate work spaces for increased safety onboard, (ii) provides independent pitch and roll motion for each longitudinal hull, and (iii) provides dampened total motion of the moveable planar platforms by at least 20% as compared to total motions of each longitudinal hull.

Example 2

One embodiment of the multihull multiplatform floating vessel can be an assembled vessel 1000 feet length over all (LOA), a beam of 680 feet, and a loaded draft of 62 feet.

Three longitudinal hulls are used. The middle hull is 1000 feet *LOA* and the flanking hulls are 830 feet long.

Each hull void is 100 feet and the three hulls are substantially parallel to each other.

The middle hull has a tapered bow to a point with a rounded stem.

Each flanking longitudinal hull has a tapered bow tapered to a point with a square, flat stern.

The middle longitudinal hull has 16 pin connectors.

The flanking longitudinal hull has 5 pin connectors

Each pin connector provides one axis motion.

In this example, the pin connector of the middle hull are mounted 8 alongside the port side of the hull and 8 alongside the starboard side of the hull.

In this example, the pin connectors of the flanking longitudinal hulls are also mounted alongside only one side, starboard or port of each longitudinal hulls.

In this example, each longitudinal hull has two joints. Each joint provides two axis motion. The joints are each mounted alongside each hull.

Six moveable planar platforms are used.

Of the six moveable planar platforms, 4 are triangular shaped and 100 feet wide and 100 feet long.

Two of the six moveable planar platforms are rectangular and are 100 feet long by 50 feet wide.

A 50 to 100 foot platform void is created, the measurement changes depending on where the void is measured between each moveable planar platform.

Each moveable planar platform is mounted 61 feet above a load line of each longitudinal hull.

The first ends of the first, third and sixth moveable planar platforms engage pin connectors. The second end of the first third and sixth moveable planar platforms engage joints.

The first ends of the second and fourth moveable planar platform engage pin connectors. The second end of the same moveable planar platforms removeably and detachably engage joints.

Each moveable planar platform extends between the plurality of longitudinal hulls and forming multiple one level structural links there between.

The platform void extends between pairs of moveable planar platforms to provide increased safety for equipment and personnel on the moveable planar platform by preventing impact together of longitudinal hulls.

A hull void extends between pairs of longitudinal hulls.

The formed multihull multiplatform floating vessel 10 has a configuration that is flexible and expandable without permanently affixing the moveable planar platforms to the longitudinal hulls, while simultaneously the multihull multiplatform floating vessel (i) provides separate work spaces for increased safety onboard, (ii) provides independent pitch and roll motion for each longitudinal hull, and (iii) provides dampened total motion of the moveable planar platforms by at least 24% as compared to total motions of each longitudinal hull.

While these embodiments have been described with emphasis on the embodiments, it should be understood that within the scope of the appended claims, the embodiments might be practiced other than as specifically described herein.

What is claimed is:

1. A multihull multiplatform floating vessel comprising:

a plurality of longitudinal hulls, each longitudinal hull spaced apart and substantially parallel to the other longitudinal hull;

a plurality of pin connectors, each pin connector providing one axis motion, wherein a first pin connector is mounted above or alongside the first longitudinal hull, and a second pin connector is mounted above or alongside the second longitudinal hull;

a plurality of joints, each joint providing two axis motion, with a joint is mounted to the first longitudinal hull spaced apart from the first pin connector, and a joint is mounted to the second longitudinal hull spaced apart from the second pin connector;

a first moveable planar platform having a first end and a second end with the first moveable planar platform mounted a preset distance above a load line of the first longitudinal hull; the first end removeably and detachably engaging the first pin connector on the first longitudinal hull, the second end removeably and detachably engaging the second joint on the second longitudinal hull;

a second moveable planar platform having a first end and a second end, with the second moveable planar platform mounted a preset distance above a load line of the second longitudinal hull; the second end removeably and detachably engaging the second pin connector on the second hull, the first end removeably and detachably engaging the first joint on the first longitudinal hull; each moveable planar platform extending across the plurality of longitudinal hulls and forming a structural link there between;

a platform void extending between pairs of moveable planar platforms to provide increased safety for equipment and personnel on the moveable planar platform by preventing impact together of longitudinal hulls;

a hull void extending between pairs of longitudinal hulls; and wherein the formed multihull multiplatform floating vessel has a configuration that is flexible and expandable without permanently affixing the moveable planar platforms to the longitudinal hulls, while simultaneously the multihull multiplatform floating vessel (i) provides separate work spaces for increased safety onboard, (ii) provides independent pitch and roll motion for each longitudinal hull, and (iii) provides dampened total motion of the moveable planar platforms by an average of at least 10% as compared to total motions of each longitudinal hull depending on environmental loading.

2. The multihull multiplatform floating vessel of claim 1, wherein the longitudinal hulls comprising at least one product storage tank located therein, and wherein at least one product storage tank is configured to allow adjustment of the draft of the longitudinal hull containing the product storage tank; further wherein at least one of the longitudinal hulls comprises a mooring system installed in the longitudinal hulls.

3. The multihull multiplatform floating vessel of claim 1, wherein the joint on the first longitudinal hull is mounted diagonal to the joint on the second longitudinal hull.

4. The multihull multiplatform floating vessel of claim 1, wherein the first moveable planar platform is oriented perpendicular to each longitudinal axis of each longitudinal hull.

5. The multihull multiplatform floating vessel of claim 1, wherein the first and second moveable planar platforms are mounted above the longitudinal hulls.

6. The multihull multiplatform floating vessel of claim 1, comprising a ballast tank in a longitudinal hull for adjusting trim and draft of the longitudinal hull.

7. The multihull multiplatform floating vessel of claim 1, wherein one of the longitudinal hulls comprises at least one pressurized product storage tank storing a flowable particulate, a liquid, a vapor/liquid combination, or compressed natural gas, and wherein the pressurized product storage tank is configured to withstand pressure between 0.4 psi and 5000 psi without deforming, and wherein the product storage tank has a fixed lid and comprises baffling internal to the tank.

8. The multihull multiplatform floating vessel of claim 1, comprising on each longitudinal hull: a plurality of pin connectors or a plurality of joints or a combination thereof.

9. The multihull multiplatform floating vessel of claim 1, wherein each longitudinal hull has a bow or a stern having a shape selected from the group: tapered to a flat face, rounded, or tapered to a point.

10. The multihull multiplatform floating vessel of claim 1, comprising a station keeping system.

11. The multihull multiplatform floating vessel of claim 1, comprising a hose connected to equipment mounted on at least one of the moveable planar platforms to fluidly engage an offloading buoy.

12. The multihull multiplatform floating vessel of claim 1, comprising from 1 to 30 joints mounted to each longitudinal hull, and wherein each joint is a member of the group comprising: an universal joint, a ball joint, a spring, and a constant velocity joint.

13. The multihull multiplatform floating vessel of claim 1, wherein each moveable platform is positioned to have at least one width comprising: a width that extends between the longitudinal hulls without extending beyond the plurality of longitudinal hulls; a width that extends beyond each longitudinal hull; a width that extends over portions of the longitudinal hulls, or a combination thereof.

14. The multihull multiplatform floating vessel of claim 1, comprising from 2 to 20 moveable planar platforms mounted over from 2 to 10 parallel longitudinal hulls.

15. The multihull multiplatform floating vessel of claim 1, wherein the moveable planar platforms are mounted in a staggered configuration over the longitudinal hulls.

16. The multihull multiplatform floating vessel of claim 1, comprising an upper deck mounted over at least one of the moveable planar platforms.

17. The multihull multiplatform floating vessel of claim 16, comprising 2 to 20 vertically integrated upper decks mounted over at least one moveable planar platform.

18. The multihull multiplatform floating vessel of claim 1, further comprising at least one member of the group consisting of: a lifting crane, a crew accommodation, an electric generators, a vent system, a fire fighting system, pirate deflection equipment, a water treatment plant, fuel gas skids, an oil and gas processing plant, a helideck, and a flare boom, at least one riser porch with flow lines, control lines, and sensor lines for importing product from to the floating vessel or offloading product from a product storage tank within at least one of the longitudinal hulls.

19. The multihull multiplatform floating vessel of claim 1, comprising: at least one surface mounted on at least one support member, wherein the support members engage the pin connectors and the joints.

20. The multihull multiplatform floating vessel of claim 1, wherein the platform void extending between pairs of moveable planar platforms is oriented at an angle from 30 degrees to 150 degrees to the hull void.

* * * * *